US005271105A

United States Patent [19]

Tyler

[11] Patent Number: 5,271,105

[45] Date of Patent: Dec. 21, 1993

[54] VACUUM FLUSH TOILET ASSEMBLY

[76] Inventor: Steven J. Tyler, 3183 Tyler St., Riverside, Calif. 92503

[21] Appl. No.: 862,518

[22] Filed: Apr. 2, 1992

[51] Int. Cl.[5] ..... E03D 11/10

[52] U.S. Cl. ..... 4/431; 4/434; 251/63

[58] Field of Search ..... 4/300, 316, 420, 431, 4/432, 433, 434, 435; 137/907; 251/30.01, 63

[56] References Cited

U.S. PATENT DOCUMENTS

| | | | |
|---|---|---|---|
| 3,239,849 | 3/1966 | Liljendahl | 4/431 X |
| 3,355,139 | 11/1967 | Kittredge | 251/30.01 |
| 3,727,877 | 4/1973 | Beguiristain | 251/63 X |
| 3,811,135 | 5/1974 | Drouhard, Jr. et al. | 4/435 |
| 3,860,973 | 1/1975 | Uyeda et al. | 4/435 X |
| 3,878,569 | 4/1975 | Peirish et al. | 4/431 X |
| 4,275,470 | 6/1981 | Badger et al. | 4/316 |
| 4,306,321 | 12/1981 | Norlin | 4/431 X |
| 4,357,719 | 11/1982 | Badger et al. | 4/316 |
| 4,376,315 | 3/1983 | Badger et al. | 4/431 |
| 4,521,925 | 6/1985 | Chen et al. | 4/321 X |
| 4,585,207 | 4/1986 | Shelton | 251/63 X |
| 4,713,847 | 12/1987 | Oldfelt et al. | 4/316 |
| 4,783,859 | 11/1988 | Rozenblatt et al. | 4/316 |

*Primary Examiner*—Henry J. Recla
*Assistant Examiner*—Robert M. Fetsuga
*Attorney, Agent, or Firm*—Knobbe, Martens, Olson & Bear

[57] ABSTRACT

A toilet assembly suitable for use on commercial passenger vehicles, including a bowl for receiving waste and waste outlet tubing connecting the bowl to a vacuum source. A flush valve assembly is provided in the outlet tubing and is selectively openable to connect the vacuum source to the bowl for sucking the waste out of the bowl. A disposable spray ring containing a plurality of holes and selectively coupled to a water source is wedged between the bowl and a separate lip member for dispensing water onto the interior surface of the bowl. The flush valve assembly includes a vacuum chamber with top and bottom vacuum inlet ports, a piston connected to a valve blade movable vertically within the chamber and a flush solenoid openable to selectively connect a second vacuum to the top and bottom inlet ports. The assembly is supported by a novel lightweight composite base having triangular composite legs.

45 Claims, 6 Drawing Sheets

FIG. 1
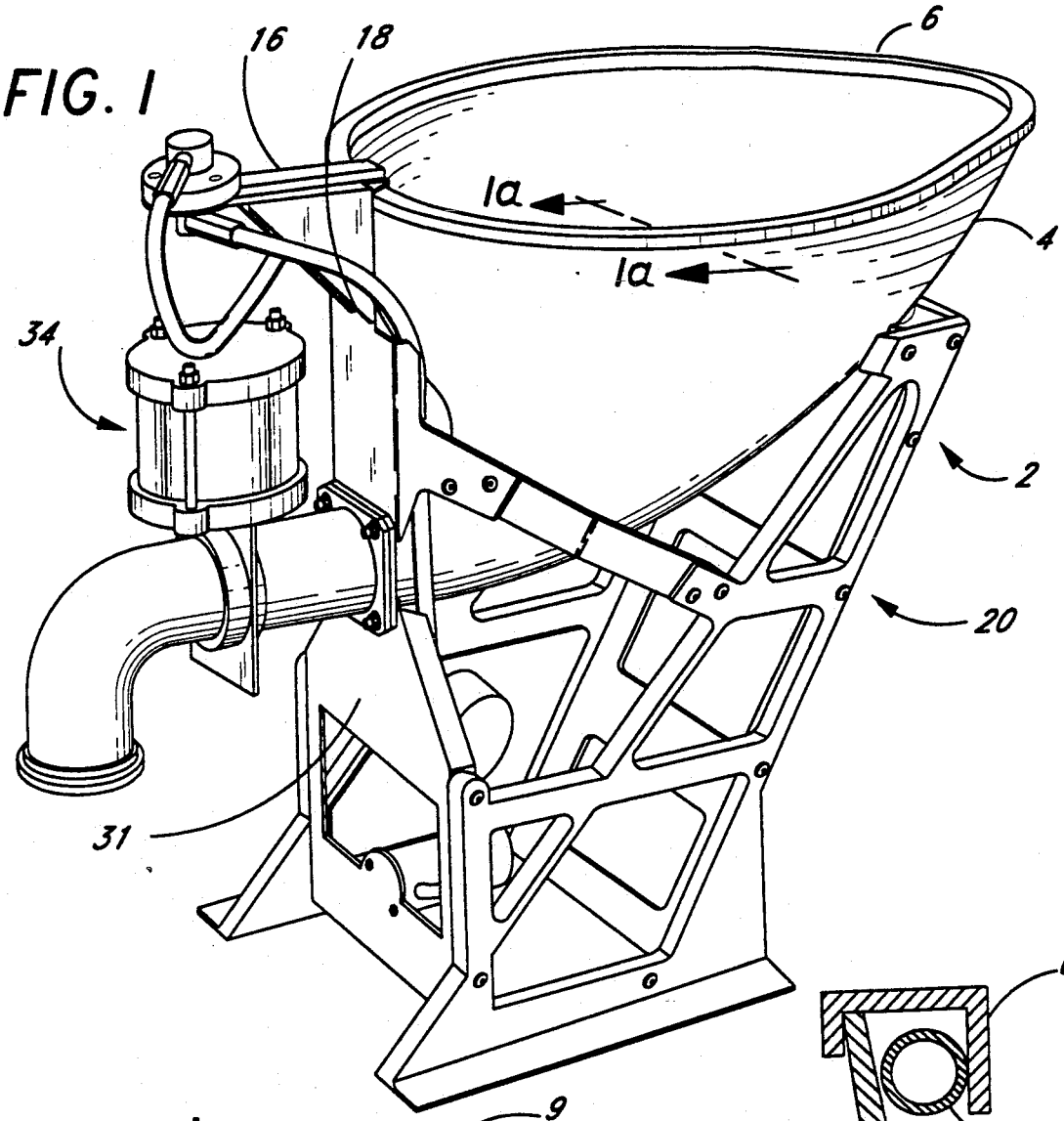
FIG. 1b
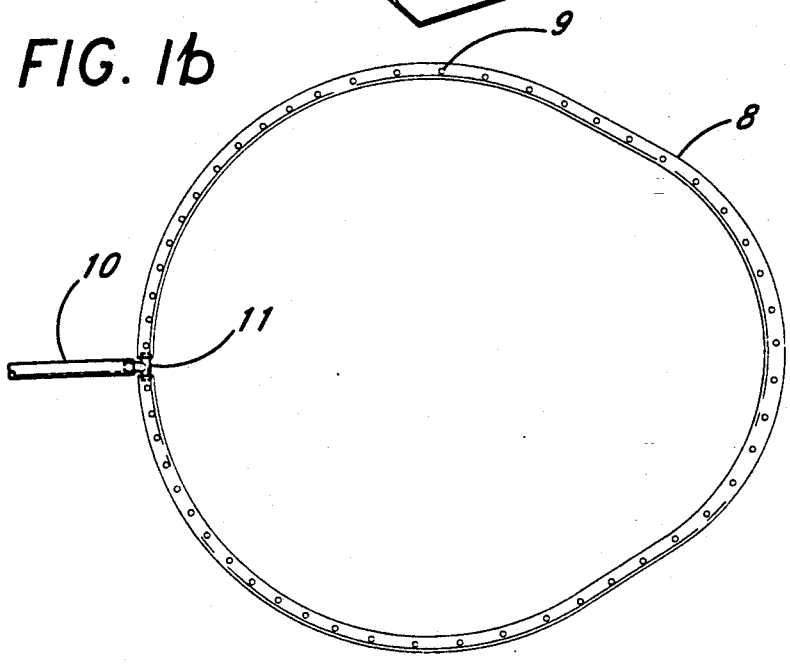
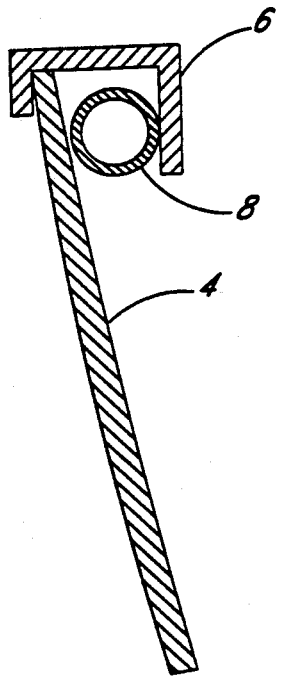
FIG. 1a

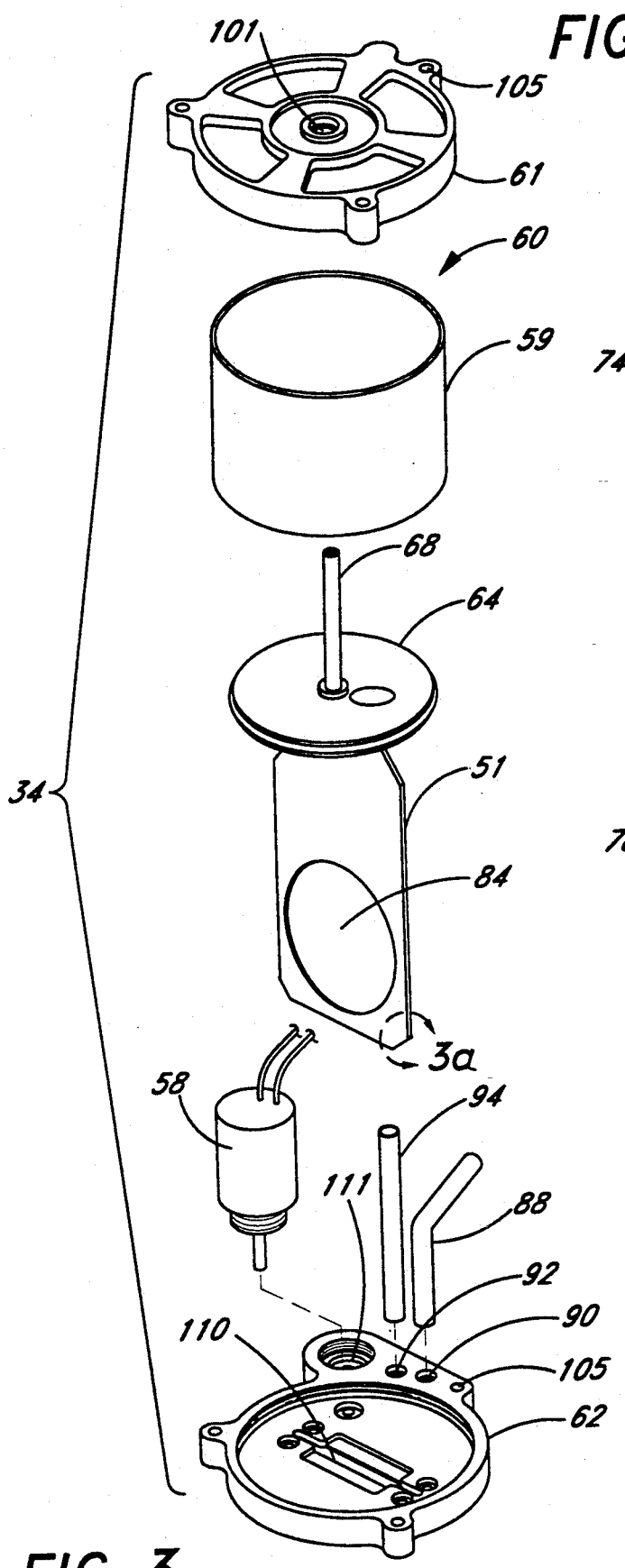
FIG. 3
FIG. 3a
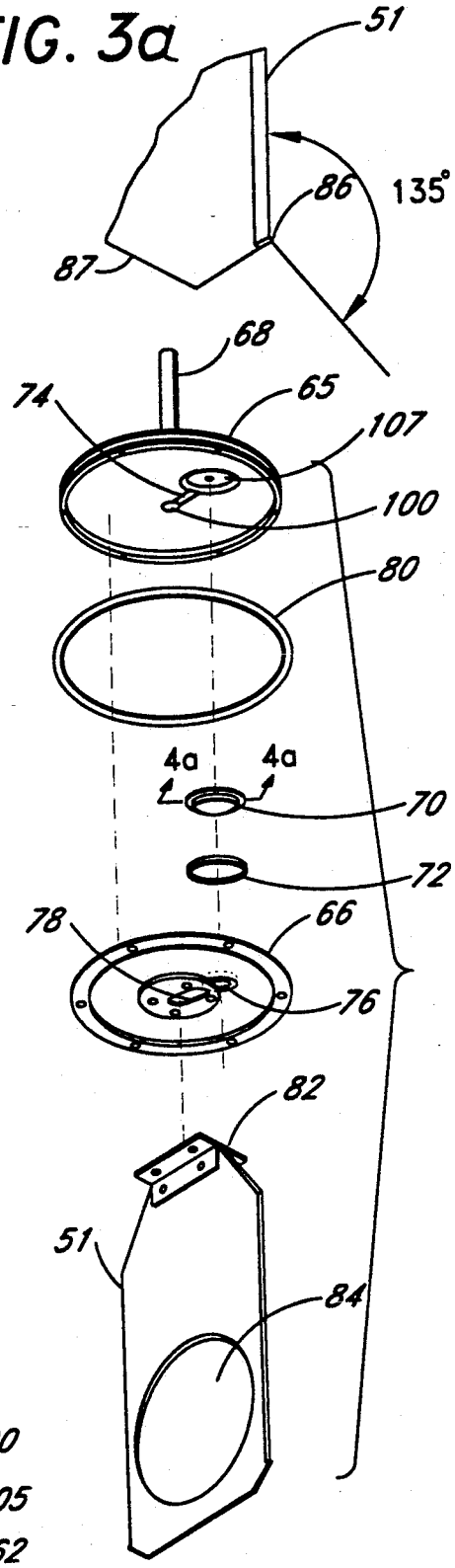
FIG. 4

FIG. 9
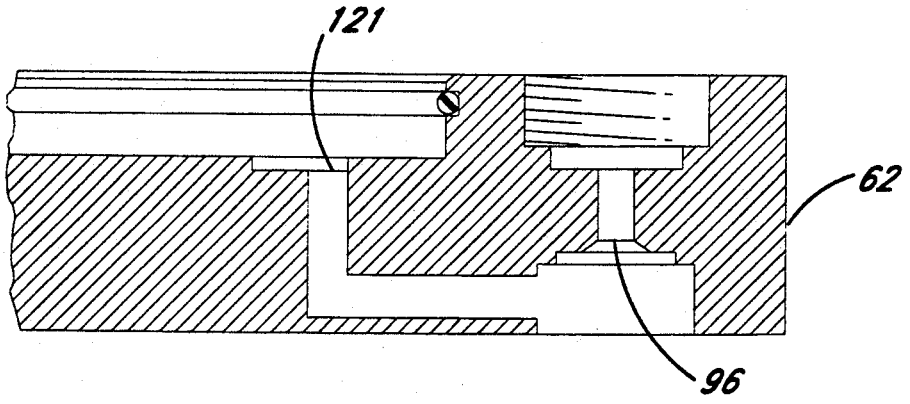
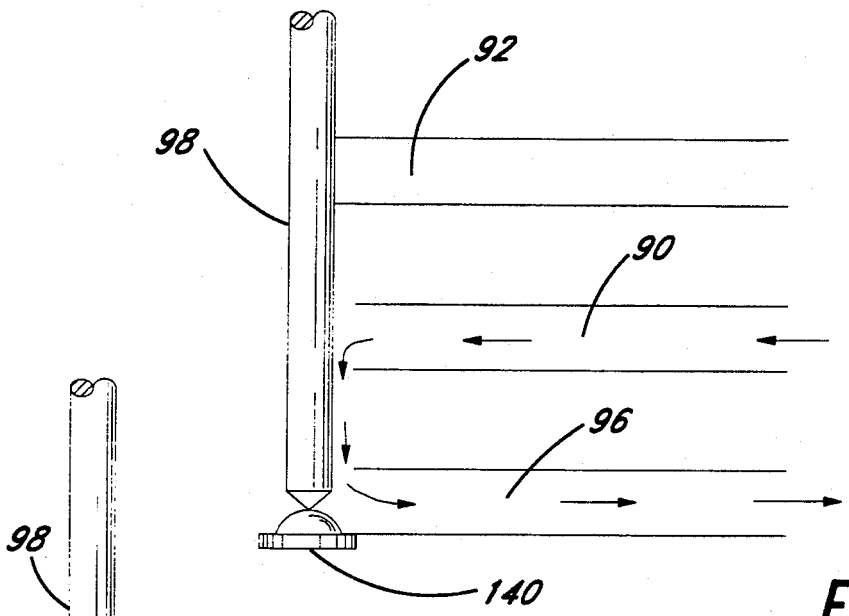
FIG. 10
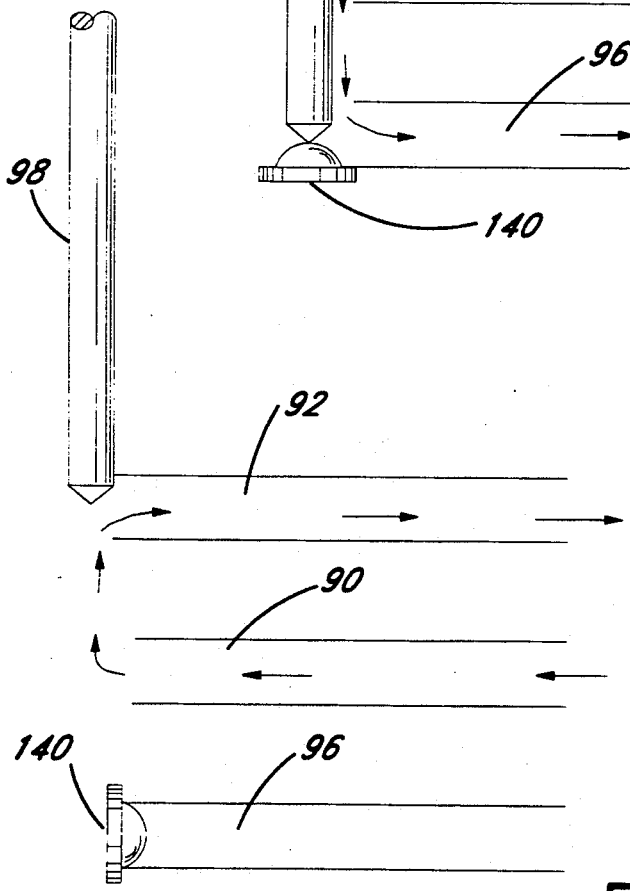
FIG. 11

VACUUM FLUSH TOILET ASSEMBLY

BACKGROUND OF THE INVENTION

This invention relates to toilet assemblies used in waste disposal systems on passenger vehicles such as buses, trains and aircraft. A preferred embodiment of a waste disposal system for railcars is described and claimed in a co-pending application, incorporated herein by reference, Ser. No. 07/862,320 (our reference NORCAN.004A) filed on the same date as the present invention and assigned to the assignee of the present invention.

The main components of such a toilet assembly are a flush valve assembly, a toilet bowl, a spray ring, a support base and a flush control unit.

In the prior art toilet assemblies, each of these components are relatively heavy and in the case of flush valve assemblies, require numerous moving parts. For instance, these prior flush valves typically incorporate motors or pneumatically driven valves having many relatively heavy moving parts. In addition, these assemblies are prone to frequent breakdowns and constant maintenance. The prior art toilet bowls are made from relatively heavy, as well as expensive stainless steel. Likewise, the prior art support bases typically comprise vertical legs typically made from steel.

The prior art toilet assemblies have additional disadvantages besides excessive weight and complexity. One disadvantage is that the prior art spray rings are formed from stainless steel tubing. When the spray holes become clogged, which is not infrequent due to lime and calcium deposits from local water sources, a chemical cleaning of the tube is required since the spray ring may not be quickly and inexpensively replaced.

Another disadvantage is that the structural configuration of the prior art support bases expose the toilet assembly to excessive tipping forces since the prior art support bases are connected at or close to the bottom of the bowl. These tipping forces are further accentuated due to the fact that the prior art support bases are not positioned under the center of gravity of the whole toilet assembly. Rather the prior art bases are positioned under the center of gravity of the bowl and fail to take into account the additional weight of the components attached to the rear of the bowl. Furthermore, the attachment of the bowl to the prior art support base requires that additional thicknesses of material (doublers) are needed on the exterior surface of the bowl for allowing the bowls to be attached to the prior art base, thus further increasing the weight of the toilet assembly.

A further disadvantage of the prior art toilet bowl assembly is that the vertical legs of the prior art support base restrict the work space between the shroud and the front of the support base.

SUMMARY OF THE INVENTION

The present invention includes significant structural and functional improvements to the toilet bowl, the spray ring, the flush valve assembly, and the support base. The improved bowl is a composite member manufactured as a prepreg lay-up member with a nickel-plated finish coating. The composite material of the present invention eliminates the need for expensive and heavy stainless steel bowls.

The improved spray ring is a disposable plastic tube. Advantageously the bowl contains a separate lip or flange mounted peripherally around the top exterior of the bowl. The spray ring simply snaps in between this lip and the toilet bowl for ease of maintenance. The disposability eliminates the need for constant cleaning of the spray ring due to lime and calcium deposits formed from local water sources.

The preferred embodiment of the valve assembly contains no motor driven parts or gear systems. The valve assembly comprises a cylindrical vacuum chamber, a flush solenoid and a valve blade. The valve blade is selectively openable, such that the valve blade in the open position connects the bowl to an outside vacuum source located in the waste outlet tubing so that the waste contained in the bowl can be sucked out.

The vacuum chamber contains a top cap with a top vacuum port and a bottom cap with a bottom vacuum port. A piston movable vertically within the chamber is connected to the valve blade such that the rise of the piston opens the valve blade and the descent of the piston closes the valve blade. A feature of the invention is that this flush valve assembly is self-cleaning such that the valve blade automatically cleans the juxtaposed face seals each time the valve is actuated.

The flush solenoid located adjacent to the chamber, is selectively openable to connect another outside pure vacuum source to the top and bottom vacuum ports on the vacuum chamber. The opening of the flush solenoid connects the pure vacuum to the top port of the chamber causing the piston to rise and the closing of the flush solenoid connects the pure vacuum to the bottom port, causing the piston to descend.

The support base used to cradle the bowl combines the use of side members in the form of obtuse, scalene triangular legs of lightweight composite material connected to each other in the front and rear of the base. The triangulated, slanted design of the support base compensates for the center of gravity of the whole assembly, including the valve assembly and the waste line tubing located behind the bowl. In addition, the design of the base enables the weight of the toilet assembly to be distributed over a greater area than in previous devices for reducing the forces which tend to tip or rotate the bowls relative to the assembly. The bowl is connected to the support base of the present invention in a manner such that the front of the bowl approximately half way down from the top of the bowl rests on the front lateral support sheet while the rear of the bowl is secured to the rear lateral support sheet. This obviates the need for doublers, and thus contributes to its light weight. The angled configuration of the composite legs also allows for more working space between the support base and the aesthetic shroud.

The use of lightweight composite material for toilet assemblies utilized on commercial passenger vehicles are advantageous from an economical standpoint. For instance, a reduction of a few pounds on commercial aircraft can lead to substantial savings on fuel costs.

In one embodiment of the present invention, the use of composite material has lowered the overall weight of the present toilet assembly to approximately 9 lbs, as opposed to 22 lbs. for prior art toilet assemblies. This reduction in weight will lead to substantial cost savings when the invention is used on commercial aircraft.

BRIEF DESCRIPTION OF THE DRAWINGS

FIG. 1 is a perspective view of the toilet assembly of the present invention;

FIG. 1*a* is a partial cross-section of the bowl taken along lines 1*a*-1*a* of FIG. 1;

FIG. 1*b* is a top perspective view of the disposable spray ring of the present invention;

FIG. 3 is an exploded view of the vacuum chamber of the present invention;

FIG. 3*a* is an enlarged partial view of the blade of FIG. 3.

FIG. 4 is an exploded view of the piston and valve blade combination of the present invention;

FIG. 9 is a partial cross-sectional view of the bottom cap taken along lines 9—9 of FIG. 8;

FIG. 10 is a schematic representation of the solenoid needle and flapper valve in relation to the vacuum ports when the flush solenoid of the present invention is in the closed position;

FIG. 11 is a schematic representation of the solenoid needle and flapper valve in relation to the vacuum ports, when the flush solenoid of the present invention is in the open position.

DETAILED DESCRIPTION OF THE PREFERRED EMBODIMENT

Figure 2:
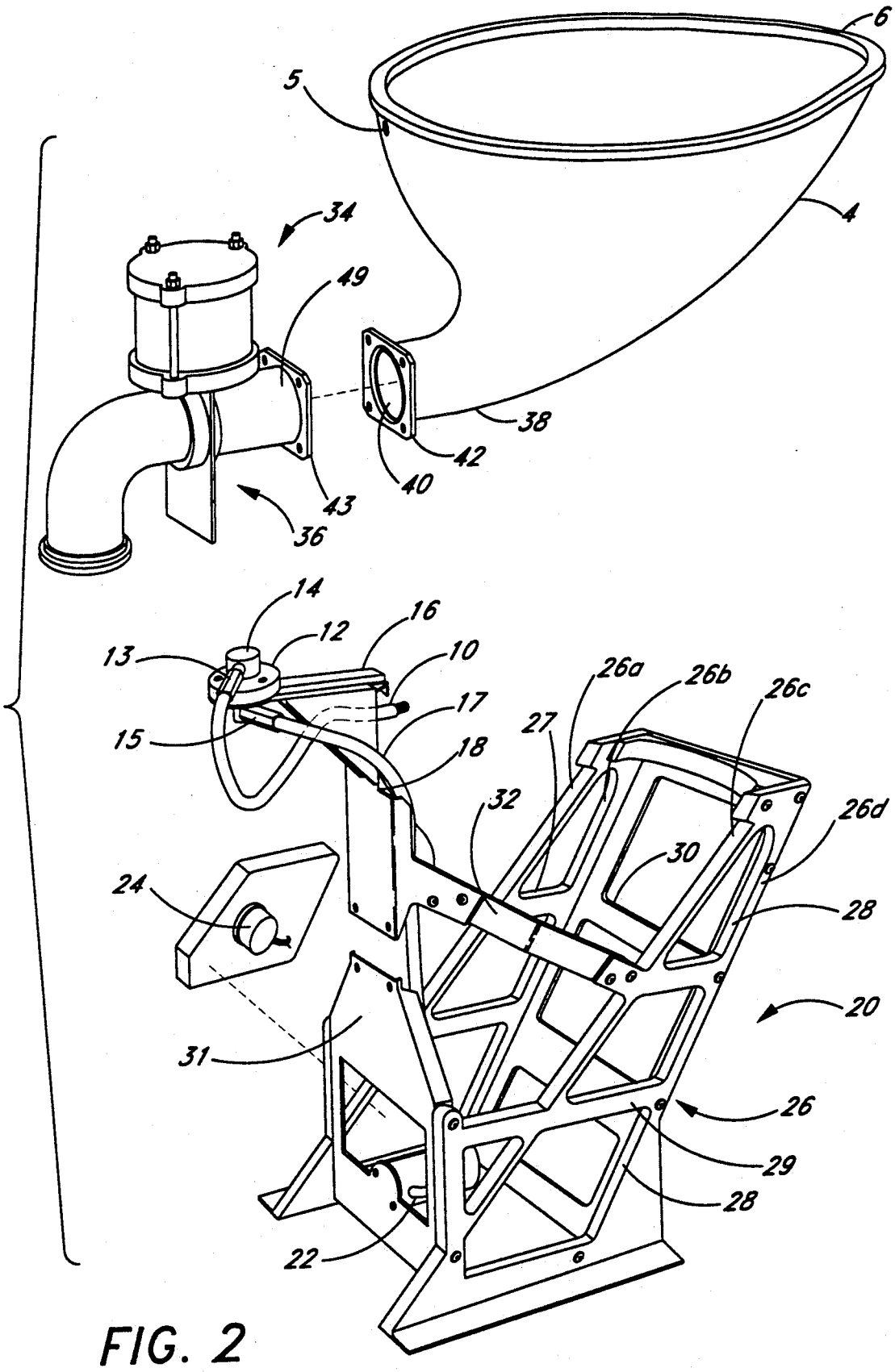
FIG. 2 is an exploded view of the toilet assembly of FIG. 1.

Referring to FIG. 1, the present invention comprises a toilet bowl assembly 2 which is light in weight and very sturdy. The assembly 2 comprises a very lightweight toilet bowl 4 advantageously constructed out of resin-impregnated fiber composite material. In the preferred embodiment, the composite material for the bowl 4 is woven fiberglass. As shown in FIG. 2, the bowl 4 has generally a funnel-like shape with a tubular bottom rear portion 38 of reduced diameter which represents the outlet for the waste contained in the bowl 4.

Referring to FIG. 1*a*, the top opening of the bowl 4 is connected to a separate lip or flange 6. This flange 6 will typically be made of plastic or stainless steel. The flange is placed circumferentially around the outer rim of the bowl 4 so that the flange 6 hangs over the bowl 4. In one embodiment, the bowl 4 and flange 6 are coated with a nickel-plated coating, which provides a very durable, abrasion-resistent, non-stick surface.

A disposable spray ring 8 is located between the bowl 4 and the flange 6. Ring 8 extends around the upper rim of the bowl 4 to provide an even spray pattern for bowl cleansing. Referring to FIG. 1*b*, in the preferred embodiment, the spray ring 8 is formed from a length of flexible plastic polyethylene tubing having two open ends with equidistantly spaced holes 9 for the emission of water onto the interior surface of the bowl 4. The tubing conforms to the shape of the rim of the bowl 4, with the two ends connected at the back of the interior of the bowl 4 to a single piece of plastic tubing 10 via a mating T-connector member 11. The spray ring 8 is simply wedged between the flange 6 and the bowl 4 for easy maintenance, as shown in FIG. 1*a*. The disposability of the spray ring 8 eliminates the need for frequent cleansing of the ring 8. When calcium and lime deposits form on the interior of the ring 8 from local water sources, the ring 8 is simply removed and disposed of and a new ring installed in it's place.

Referring to FIG. 2, the back of the bowl 4 contains an opening 5 so that the tubing 10 can extend through the opening 5 and connect to a potable fresh water source (not shown), which will supply the water necessary to cleanse the bowl 4.

The end of the tubing 10 away from the mating member 11 is connected to the output fitting 13 of an anti-siphon valve 12. The anti-siphon valve 12 only permits flow of water in one direction for sanitary purposes, so that waste water from the bowl 4 will not be able to travel from the bowl 4 back through the plastic tubing 10 and into the potable fresh water source (not shown).

The anti-siphon valve 12 advantageously includes an anti-freeze mechanism having a return conduit. As shown in FIG. 2, the output fitting 13 is connected to a plastic top 14 of the anti-syphon valve 12 which accumulates surplus water. One end of a rectangular shaft 16 containing one or more water return channels is connected to the bottom of the anti-siphon valve 12 for providing a passage for the water that has accumulated in the top 14 of the anti-syphon valve 12 and for preventing excess water from freezing inside of the top 14. The rectangular shaft 16 lies on top of a support member 18 of the support base 20, which will be discussed later. As shown in FIG. 1, the distal end of the shaft 16 is attached to the flange 6 and overhangs the rim of the bowl 4 so that the accumulated water is returned to the bowl 4.

Referring back to FIG. 2, the input fitting 15 of the anti-siphon valve 12, is connected via tube 17 to the outlet port of a rinse solenoid valve 22, which is attached to the rear of the support base 20. The inlet port of the rinse solenoid valve 22 is connected to an outside potable fresh water source (not shown). The rinse solenoid valve 22 in the closed position will not allow water from the potable fresh water source to enter the spray ring 8. However, the rinse solenoid valve 22 when activated to it's open position, will allow water to pass through the tubing 17, the anti-syphon valve 12, the tubing 10 and finally into the spray ring 8. The rinse solenoid valve 22 is activated by a timer/electronic control module 24 discussed below.

The bowl 4 of the present invention is supported by a novel support base 20 comprising a front sheet 30, a rear sheet 31 and side members 26 shown in FIGS. 1 and 2. The bowl 4 is cradled by the support base 20 such that the front of the bowl 4 approximately half way down from the top of the bowl 4 rests on the front sheet 30 of the base 20 while the rear 38 of the bowl 4 is secured in between the rear sheet 3 of the base 20 and the support member 18 as shown in FIG. 1.

Referring to FIG. 2, the side members 26 of the support base 20 are generally in the shape of an obtuse, scalene triangle and formed by legs 26*a*, 26*b*, 26*c* and 26*d* made out of light weight composite material. In the preferred embodiment, the composite material for these legs is shredded glass fiber impregnated with phenolic-resin or hard anodized aluminum. The legs 26*a* and 26*b* are connected to each other by horizontal composite bars 27, while legs 26*c* and 26*d* are connected to each other by horizontal composite bars 29. The legs 26*a*, 26*b*, 26*c*, 26*d* and composite bars 27,29 define openings 28 in the side members 26 for an additional reduction in weight. The side members 26 are connected to each other in the front and back via stainless steel sheets 30, 31 for better lateral support. The front sheet 30 contains parallelogram-like openings and is larger than the rear sheet 31. The upper portion of legs 26a and 26c are connected to support bars 32, which in turn are connected to a support member 18 where the rectangular shaft 16, which was discussed earlier, is placed.

The advantages of having this particular design for the base 20 are numerous. For instance, when a shroud (not shown) eventually encases the support base 20 for aesthetic purposes, the slanted obtuse, scalene triangular shape of the side members 26 create more room between the support base 20 and the shroud. This extra room is especially advantageous when work needs to be done on the toilet assembly 2. In addition, the triangulated shape of the base 20 takes into account the center of gravity of the whole assembly 2 by compensating for the extra weight of the valve assembly 34 and the waste line tubing 36 (shown in FIG. 1) located behind the bowl 4. The shape of the base 20 also provides for a better distribution of the weight of the bowl 4 by making contact higher up on the bowl 4 as opposed to prior devices. Finally, the fact of having the bowl 4 cradled by the support base 20 as opposed to being hard mounted, obviates the need for heavy metal doublers.

Referring to FIG. 2, the bottom rear of the bowl 38 contains an exit opening 40 which is connected to a waste outlet tubing 36 by means of a flange attachment. The rear 38 of the bowl 4 is secured to the top of the rear sheet 31 of the base 20 and the bottom of the support member 18 via the flange attachment, as shown in FIG. 1.

Referring to FIG. 2, a first mating flange 42 is adhesively attached onto the rear 38 of the bowl 4. A second mating flange 43, welded to one end of a piece of straight outlet tubing 49, is screwed onto the first mating flange 42 with the top of the rear sheet 31 of the base 20 and the bottom of the support member 18 held in between as shown in FIG. 1

Figures 4A, 5:
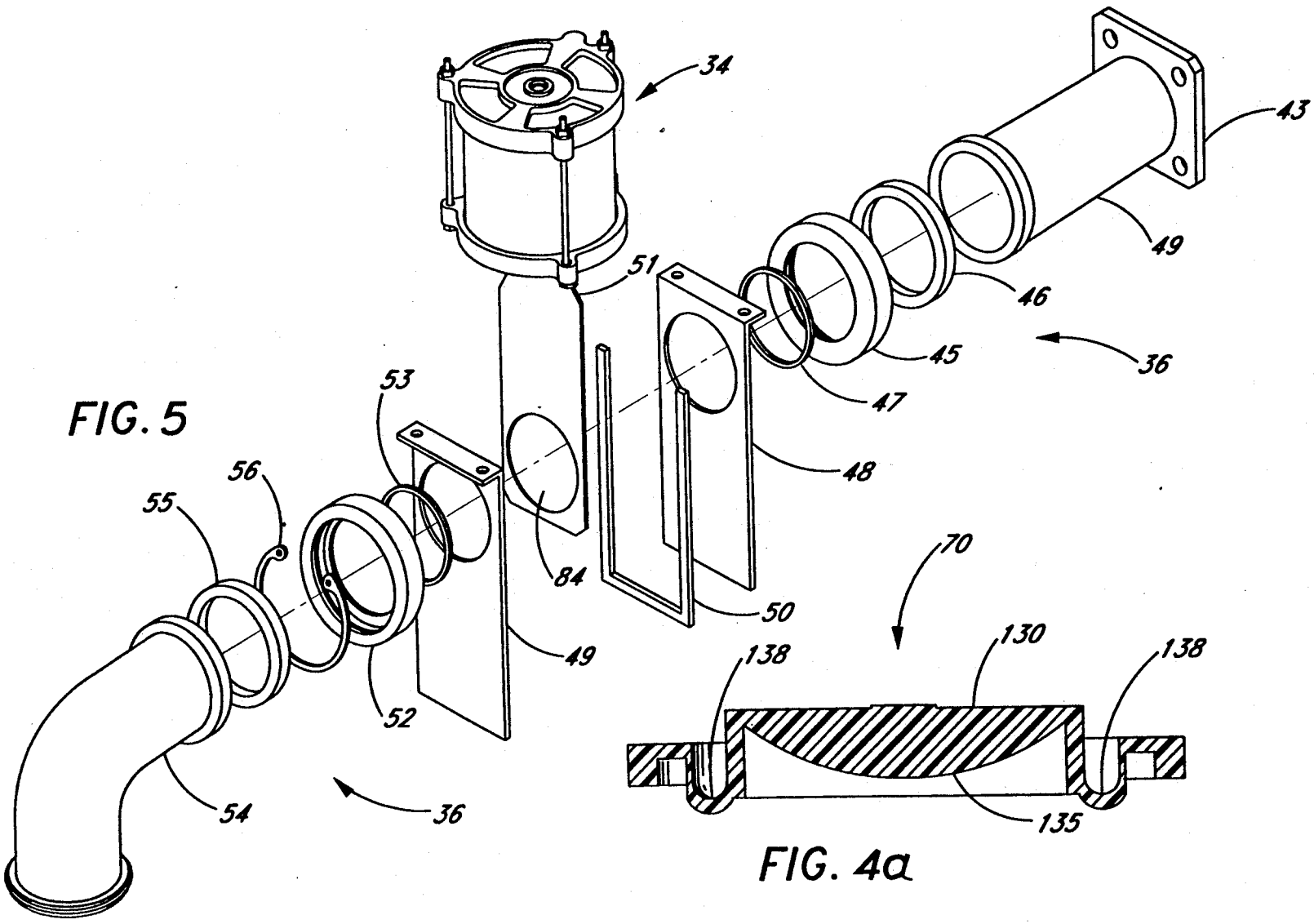
FIG. 4*a* is an enlarged cross-sectional view of the diaphragm of FIG. 4 taken along lines 4*a*-4*a*.
FIG. 5 is an exploded view of the waste outlet tubing in relation to the valve assembly of the present invention.

The intended construction of the flush valve assembly 34 is shown in FIGS. 3–8. Referring to FIG. 5, the remainder of the waste outlet tubing 36 has the distal end of tube 49 welded onto a first large flange 45, which is welded over a first small flange 46. The first large flange 45 contains an interior groove in which a first spring loaded internal face seal 47 is located. This combination of a first large flange 45, a first small flange 46 and a first internal face seal 47 is welded onto a first valve body 48. The first valve body 48 is connected to a second valve body 49. A U-shaped spacer 50 is in juxtaposition with respect to the valve bodies 48, 49. The valve blade 51, which will be discussed later, is slidable in between the opening of the spacer 50.

The distal side of the second valve body 49 is connected to a second large flange 52. The second large flange 52 contains a second internal face seal 53 located within an internal groove. Both face seals 47, 53 will make flush contact with the valve blade 51 so that no air or particles can get trapped between the valve bodies 48, 49. The face seals 47, 53 utilized are a commercially standard unit containing an external circumferential groove where a continuously wound helical spring (not shown) is located. These springs are calibrated in a conventional manner by a manufacturer such as Ball seal such that the seals 47, 53 will provide enough force onto the blade 51 to create a seal without impeding the blade's movement. The face seals provide a separate function of cleaning the surfaces of the blade 51 as the blade 51 slides up and down.

Finally, an elbow tubing 54 having one end welded onto a second small flange 55 is connected to the second big flange 52 via an internal spring ring 56. The distal end of the elbow tube 54 is connected to a drain line (not shown) which is eventually connected to an outside waste tank (not shown). These types of components allow for quick connecting and disconnecting of the flush valve assembly 34 without the use of conventional nuts and bolts. All the components utilized in the connecting of the waste outlet tubing 36 are advantageously made out of stainless steel.

Referring to FIGS. 3 and 4, the portion of the flush valve assembly 34 located on top of the waste outlet tubing 36 comprises a flush solenoid 58, a vacuum chamber 60, a piston 64 and the valve blade 51. The vacuum chamber 60 comprises a hollow cylindrical tube 59, a top cap 61 and bottom cap 62. The top and bottom caps 61, 62 are retained on the hollow tube 59 via threaded bolts extending through holes 105 and secured by complementary nuts (see FIG. 5).

The bottom cap 62 contains a slot 110 as shown in FIG. 3, so that the blade 51 can move freely in and out of the chamber 60. The slot 110 contains a shop-made rubber gasket (not shown) with sufficiently close tolerances to seal the vacuum within the chamber 60.

Figure 6:
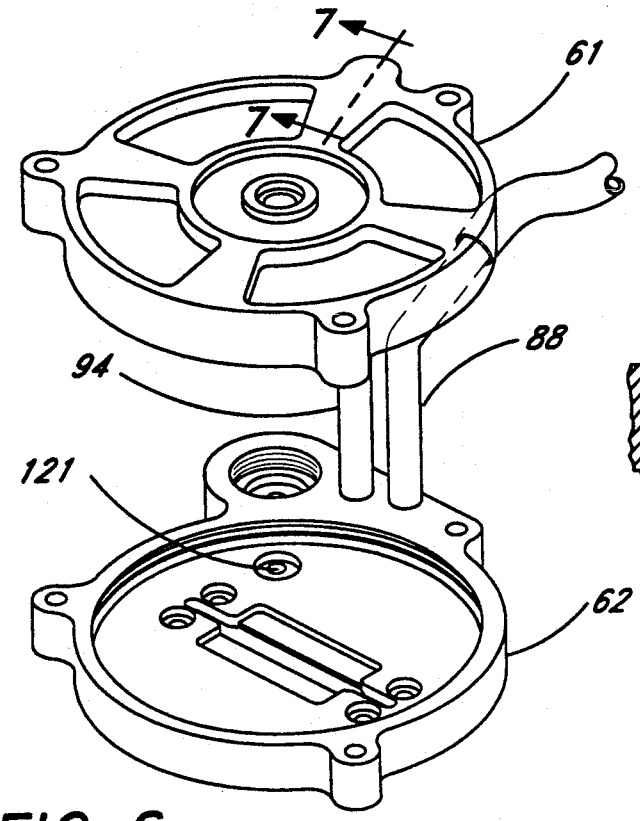
FIG. 6 is a perspective view of the top and bottom caps of the vacuum chamber of the present invention.
Figure 7:
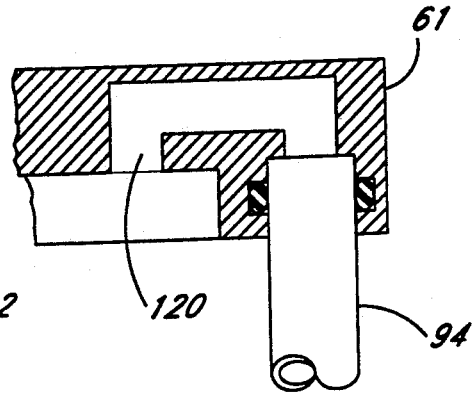
FIG. 7 is a partial cross-sectional view of the top cap taken along lines 7—7 of FIG. 6.

Furthermore, there are three openings located within the bottom cap 62. A first vacuum port 90 located in the bottom cap 62 is connected to an outside pure vacuum source (not shown but discussed later) via a metal inlet tube 88 as shown in FIGS. 3 and 6. A second opening 92 located on the bottom cap 62 is linked to a vacuum port 120 shown in FIG. 7, located in the top cap 61 via a second metal tube 94 which extends from the bottom cap 62 to the top cap 61 as shown in FIGS. 3 and 7. Finally, a third opening 96 shown in FIG. 8, located in the bottom cap 62 is linked to a vacuum port 121 shown in FIG. 9 is also located in the bottom cap 62.

Figure 8:
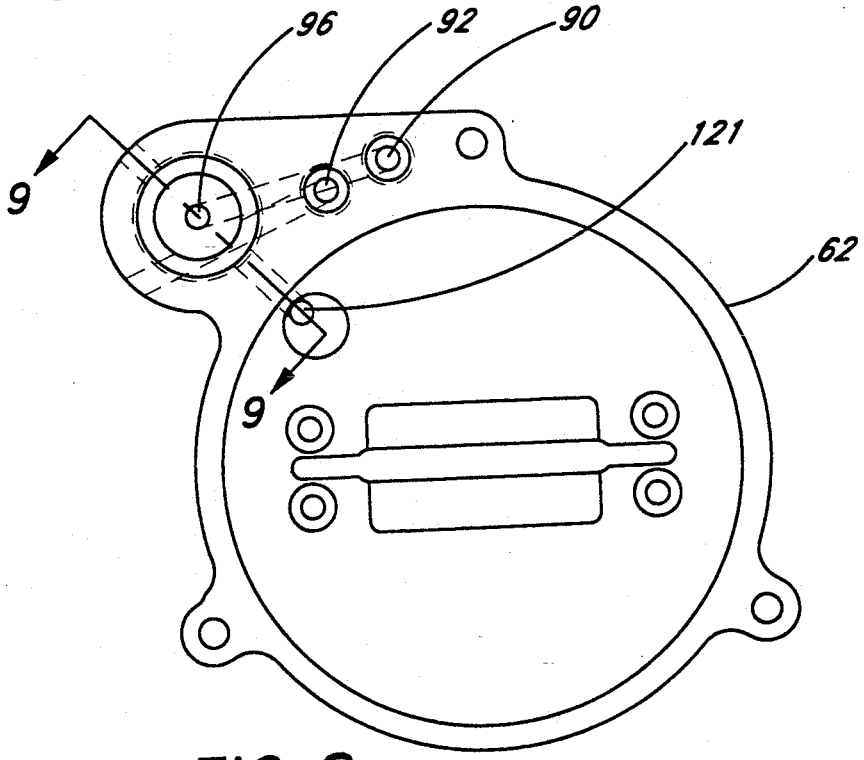
FIG. 8 is a top plan view of the bottom cap of the vacuum chamber of the present invention.

The vacuum connected to tube 88 is a pure vacuum since it is connected to a vacuum blower (not shown) on a line separate from the waste tank (not shown) so that there is no chance of fine particles of waste impeding the flow of vacuum. The path taken by the vacuum within the flush valve assembly 34 is described with reference to FIGS. 3, and 6–11. In the description, the vacuum is sometimes referred to as a positive pressure source for ease of explanation. It is understood of course, that the actual flow of air will be in reverse direction. When vacuum is introduced through the tube 88 from a pure outside vacuum source, the vacuum will take the following path: The vacuum will enter the first port 90 from the tube 88 and then proceed to the second opening 92. As described in more detail hereinafter with respect to FIGS. 10 and 11, depending on whether the flush solenoid 58 is open or closed, the vacuum will either (i) bypass the second opening 92 or (ii) enter it and proceed to the vacuum port 120 located in the top cap 61 (FIG. 7). If the vacuum bypassed the second opening 92, the vacuum will then pass to and through the third opening 96 and proceed to the vacuum port 121 located in the bottom cap 62 (FIGS. 8 and 9).

As shown in FIGS. 3 and 4, a plastic piston 64 in the shape of a disc is located within the interior of the chamber 60. As shown in FIG. 4, the piston 64 contains an external circumferential groove where a commercially standard spring loaded face seal 80 is contained to seal the vacuum source either above or below the piston 64 within the chamber 60.

Referring to FIG. 4, the piston 64 is made up of top and bottom circular pieces 65, 66 which are screwed together. By way of specific example, the plastic material Ulten 2000 sold by General Electric is advantageously used as the material for the pieces 65,66 of piston 64. The center of the top piece 65 of the piston 64 contains a hole 100 affixed to a hollow air tube 68. As shown in FIG. 3, the top cap 61 contains a centrally located hole 101, through which extends the distal end of the tube 68 in sliding engagement. This distal end is exposed to outside ambient air and as described below, this tube 68 enables an interior cavity 74 of the piston 64 to be exposed to the outside ambient air.

Referring back to FIG. 4, the interior of the top piece 65 of the piston 64 contains a recess 107 located radially outward from the hole 100 for the placement of a circular diaphragm 70 which is discussed in detail below. The diaphragm 70 is kept in the recess 107 by a retainer 72. The recess 107 is connected to the hole 100 via a first recessed slot or cavity 74 located on the interior lower surface of the top piece 65 of the piston 64.

The interior upper surface of the bottom piece 66 of the piston 64 contains a second through opening 76 located adjacent to the diaphragm 70 when the top and bottom pieces 65, 66 of the piston 64 are screwed together. The center of the bottom piece 66 of the piston 64, which is in juxtaposition with the bottom hole 100, and the second opening 76 are connected via a second recessed slot 78, located on the bottom piece 66 which will create a channel or cavity within the piston 64 when mated with the first recessed slot 74 located on the interior surface of the top piece 65.

As shown in FIG. 4*a*, the diaphragm 70 is a flexible rubber disc having a main portion capable of moving in or out of the recess 107. The main portion of the diaphragm 70 has a substantially flat side 130 which is juxtaposed in close proximity to the recess 107 and a semi-circular opposite side 135 spaced away from the recess 107. The retainer 72 is secured to the diaphragm 70 via a circumferential groove 138 around the main portion of the diaphragm 70. The area between the main portion and the groove 138 is flexible to allow the main portion of the diaphragm 70 to either move toward or away from the recess 107. When a vacuum is created above the piston 64, the main portion of the diaphragm 70 will move toward the recess 107 and away from the second opening 76 such that the flat side 130 will be flush with ceiling of the recess 107 and the semi-circular side 135 will be distanced from the opening 76. This permits ambient air to flow through tube 68 from outside the top cap 61 to the second opening 76 and into the bottom portion of the chamber 60.

When a vacuum is created above the piston 64, the main portion of the diaphragm 70 will move away from the recess 107 and toward the opening 76 such that the flat side 130 will be distanced from the ceiling of the recess 107 and the semi-circular side 135 will be flush against the opening 76. When the diaphragm 70 blocks the opening 76, ambient air cannot escape from the tube 68 and the cavity 74 to the bottom of the chamber 60 below the piston 64. Otherwise, the vacuum created beneath the piston 64 would suck the ambient air from outside the chamber 60 through the tube 68 and the opening 76. Thus, the diaphragm 70 closes off the opening 76 as discussed previously to create a suction causing the piston 64 to descend.

Referring to FIG. 4, a flexible valve blade 51 made out of stainless steel is connected to the bottom 66 of the piston 64 via a gasket 82, creating a unitary body. When the piston 64 rises, the blade 51 rises also.

The blade 51 contains a circular port 84 which will coincide with the interior bores of the waste line tubing 36 when the blade 51 is raised as shown in FIG. 5. The blade 51 is slidably retained within the opening of the spacer 50 as discussed earlier. The outside diameter of the blade 51 is less than the inside diameter of the spacer 50. The spacer 50 and the blade 51 have approximately the same thickness.

A significant feature of the invention is that the flush valve assembly 34 is a self-cleaning unit. Referring to FIG. 3*a*, the blade 51 contains notches 86 on both ends of its bottom edge 87 which automatically cleans the face seals 47, 53 each time the valve assembly 34 is actuated. As noted above, the face seals 47,53 reciprocally clean the surfaces of the valve blade 51 each time the valve blade 51 is actuated.

Referring back to FIG. 3, a flush solenoid 58 is connected to the chamber 60 via an opening 111 on the bottom cap 62. In the preferred embodiment, the solenoid 58 comprises a cylindrical shell having a needle element 98 and a circular flapper valve 140, shown schematically in FIGS. 10 and 11. The solenoid 58 is actuated by the control module 24 which is discussed later.

Referring to the schematic FIGS. 10 and 11, the vacuum path, in relation to the openings 90, 92, 96 located in the bottom cap 62 of the chamber 60, has been simplified. When the solenoid 58 is in the closed position as shown in FIG. 10, the solenoid needle 98 blocks off the second opening 92 so that the vacuum source of the first port 90 is connected only to the third opening 96 which will create a vacuum in the bottom portion of the chamber 60 through the port 121 located in the bottom cap 62. This will cause the piston 64 to either move down in the chamber 60 or, if the piston 64 is already at the bottom of the chamber 60, the piston 64 will remain so. When the solenoid 58 is in the open position as shown in FIG. 11, the needle 98 will move up causing the flapper valve 140 to pivot or tilt due to the air movement and block the third opening 96. Now the vacuum from the first port 90 is only connected to the second opening 92 which is linked to the port 120 located on the top cap 61 (FIG. 7). This will create a vacuum in the top of the chamber 60 causing the piston 64 to move upwardly.

It will thus be seen that the novel flush valve assembly 34 of the present invention is of relatively simple construction with relatively few parts. For instance, the lowering of the piston 64 to the bottom of the chamber 60 is achieved by the diaphragm and the air contained in the tube 94. Another feature of the invention is that during the descent of the piston 64, the ambient air that was contained in the tube 94 will bleed into the top portion of the chamber 60 above the piston 64, to eliminate the vacuum that was created there earlier, allowing the piston 64 to rapidly descend down in the chamber 60. Likewise, during the rise of the piston 64, the tube 68 enables the area beneath the piston 64 to fill with ambient air so that the force of the vacuum that is created above the piston 64 will not be impeded by a counteracting vacuum force located beneath the piston 64.

Referring back to FIG. 2, located in between legs 26*a* and 26*b* of the support base 20 is a timing mechanism/control module 24 of the type well known in the prior art. The timing mechanism/control module 24 establishes when the solenoids 22, 58 should open and close. The control module/timing mechanism 24 control the operation of the toilet assembly 2 through sequenced micro-switches.

In operation, when the user depresses the flush button located on the lavatory module (not shown), a signal will be sent to the electronic control unit 24 to activate the outside vacuum source while simultaneously initiating the toilet flush cycle.

The control unit 24 will then alert the rinse solenoid 22 to actuate into the open position. This will allow water from the potable fresh water source (not shown) to proceed through the plastic tubing 17, through the anti-siphon valve 12, through the plastic tubing 10 again , through the spray ring 8 and out onto the interior surface of the bowl 4, dispensing 12–14 ounces of water. The amount of water and the placement of the holes 9 on the spray ring 8 should be able to fully rinse the interior surface of the bowl 4.

Then the control module 24 will alert the rinse solenoid 58 to close, thus shutting off the water supply to the bowl 4. This rinse cycle will take at most two seconds. One second after the initiation of the rinse cycle, the control module 24 will alert the flush solenoid 58 to actuate to the open position. Initially, the piston 64 will be located at the bottom of the chamber 60 due to the fact that the flush solenoid 58 is closed.

However, when the flush solenoid 58 is activated open, the needle 98 will move up, causing the flapper valve 140 to tilt and close off the third opening 96 linked to the bottom port 121 as shown in FIG. 11. The pure outside vacuum will enter the bottom cap 62 of the chamber 60 via the first port 90. The vacuum will then enter the second opening 92 linked to the second port 120 located in the top cap 61 via tube 94. This will create a vacuum in the top of the chamber 60, causing the piston 64 to rise.

As the piston 64 rises, ambient air will proceed through the tube 68 and then through the channel created by the recessed slots 74, 78, eventually bleeding off through the second opening 76 to an area below the piston 64 due to the fact that the diaphragm 70 is not blocking the opening 76.

When the piston 64 moves up, since it is connected to the valve blade 51 via the gasket 82, the blade 51 will move up through the slot 110 of the bottom cap 62. The lift of the blade 51 will cause the port 84 on the valve blade 51 to coincide with the interior bores of the waste line tubes 36. Thus, the outside vacuum contained in the waste line tubes 36 will suck the waste located in the toilet bowl 4 out to an outside waste tank (not shown). The flush solenoid 58 will remain open for approximately four seconds, allowing sufficient time for complete cleaning of the lines between the bowl 4 and tank.

Once the four seconds are up, the timing mechanism-/control module 24 will close the flush solenoid 58. The closing of the flush solenoid 58 will cause the needle 98 to move down and block the second opening 92 linked to the port 120 in the top cap 61, as shown in FIG. 10. The flapper valve 140 will tilt back down, opening the third opening 96 which is linked to the port 121 located in the bottom cap 62. The needle 98 will eventually come to rest on top of the flapper valve 140 as shown in FIG. 10.

Now the vacuum located in the first port 90 will be redirected to the third opening 96, which is linked to the bottom port 121, creating a vacuum below the piston 64 in the bottom of the chamber 60. This will cause the piston 64 to move down. The main portion of the diaphragm 70 during the descent will move outward from the recess 107 of the top piece 65 such that it will block the second opening 76 on the bottom piece 66. Now ambient air from the air tube 68 will not be able to enter below the piston 64. As discussed earlier, the closing of the diaphragm 70 will allow a vacuum suction to be created below the piston 64 causing the piston 64 to descend. Air that was located in the tube 94 linking the second opening 92 to the port 120 on the top cap 61 will now bleed into the area above the piston 64 in the top of the chamber 60 facilitating the descent of the piston 64 with the air tube 68. As discussed earlier, this surplus ambient air is necessary to eliminate the vacuum that was present in top of the chamber 60 above the piston 64 to facilitate the descent of the piston 64. The lowering of the piston 64 will thus lower the blade 51, moving the opening 84 of the valve blade 51 away from the interior bores of the waste line tubes 36 thus closing off the vacuum suction to the bowl 4.

The control module 24 will then simultaneously shut off the outside vacuum source approximately six seconds after the start of the flush cycle. The flush cycle is now complete and ready for another cycle.

The present invention discloses a novel lightweight vacuum-operated flush waste toilet assembly utilizing a valve assembly having relatively few moving parts. The present toilet assembly uses lightweight yet strong composite material for many of the components of the assembly. Furthermore, the novel design of the support base provides for a more secure support of the toilet bowl. The composite materials used in this invention are substantially lighter in weight than their prior art counterparts. The reduction in the overall weight of the toilet assembly will lead to a substantial reduction in operation costs when the invention is used aboard commercial aircraft.

What is claimed is:

1. A vacuum-operated flush waste disposal toilet assembly for use on board commercial passenger aircraft, as well as trains, buses and ships, said assembly comprising:

a bowl for receiving waste matter;

a spray ring for supplying rinse water to said bowl, said spray ring having a disposable hollow tube selectively coupled to a source of water and having a plurality of openings for dispensing the water onto the interior surface of said bowl, said disposable spray ring obviating the need for routine chemical cleaning; and a flush valve assembly coupled to a first vacuum source and to said bowl and being selectively openable to flush said bowl, said valve assembly including:

a valve blade movable between (i) an open position which opens the path between said first source of vacuum and to said bowl to suck waste out of said bowl, and (ii) a closed position which closes the path between said first source of vacuum and said bowl;

a vacuum chamber having first and second vacuum inlet ports substantially at opposite ends of said chamber;

a piston vertically movable within said chamber, said piston being attached to said valve blade so that said piston is substantially perpendicular to said valve blade so that translation of said piston in one direction causes said blade to be translated to its open position and translation of said piston in the opposite direction causes said blade to be translated to its closed position;

said piston having an internal cavity connected to outside ambient air;

a valve between said internal cavity and one side of said piston so that (i) said cavity is open to one side of said chamber when a vacuum is supplied to the opposite side of said chamber, and (ii) said cavity is closed to said chamber when vacuum is supplied to said one side; and a flush solenoid which selectively connects a second source of vacuum to said first and second vacuum ports so that vacuum introduced at said first port causes movement of said piston in said one direction to translate said blade to said open position and vacuum introduced at said second port causes movement of said piston in the opposite direction to translate said blade to said closed position.

2. A vacuum-operated flush waste disposal toilet assembly for use on board commercial passenger aircraft, as well as trains, buses and ships which reduced the tendency for forces to tip or rotate the toilet bowl relative to a support base, said assembly comprising:

a bowl for receiving waste matter having a front portion, a rear portion and a top portion;

a flush valve assembly connected to said bowl for selectively connecting a source of vacuum to said bowl to suck waste out of said bowl; and a lightweight support base having a front end, a back end and side members including a pair of composite, slanted, obtuse triangular legs, said front portion of said bowl about halfway down from said top portion of said bowl resting on the front end of said base and said rear portion of said bowl being secured onto the back end of said base while said side members connect said front end of said base to said back end of said base so that said support base compensates for the center of gravity of the whole assembly.

3. A vacuum-operated flush waste disposal toilet assembly for use on board commercial passenger aircraft, as well as trains, buses and ships, said assembly comprising:

a bowl for receiving waste matter; and a flush valve assembly coupled to a first vacuum source and to said bowl and being selectively openable to flush said bowl, said valve assembly including:

a valve blade movable between closed and open positions, said valve blade in the open position connecting said first source of vacuum to said bowl to suck waste out of said bowl;

a vacuum chamber having first and second vacuum inlet ports substantially at opposite ends of said chamber;

a piston vertically movable within said chamber, said piston attached to said valve blade so that the movement to said piston in one direction opens said blade and the movement of said piston in the opposite direction closes said blade; and a flush solenoid which selectively connects a second source of vacuum to said first and second vacuum ports so that vacuum introduced at said first port causes movement of said piston in one direction to move said blade to said open position and vacuum introduced at said second port causes movement of said piston in the opposite direction to move said blade to said closed position, said piston having a diaphragm which is selectively openable, so that when said flush solenoid connects said second source of vacuum to said first port, said diaphragm is opened and when said flush solenoid connects and second source of vacuum to said second port, said diaphragm is closed, said diaphragm in the open position causing movement of said piston in said one direction and said diaphragm in the closed position causing movement of said piston in the opposite direction.

4. A vacuum-operated flush waste disposal toilet assembly for use on board commercial passenger aircraft, as well as trains, buses and ships, said assembly comprising:

a bowl for receiving waste matter; and a flush valve assembly coupled to a first vacuum source and to said bowl and being selectively openable to flush said bowl, said valve assembly including:

a valve blade movable between closed and open positions, said valve blade in the open position connecting said first source of vacuum to said bowl to suck waste out of said bowl;

a vacuum chamber having first and second vacuum inlet ports substantially at opposite ends of said chamber;

a piston vertically movable within said chamber, said piston attached to said valve blade so that the movement of said piston in one direction opens said blade and the movement of said piston in the opposite direction closes said blade; and a flush solenoid which selectively connects a second source of vacuum to said first and second vacuum ports so that vacuum introduced at said first port causes movement of said piston in said one direction to move said blade to said open position and vacuum introduced at said second port causes movement of said piston in the opposite direction to move said blade to said closed position.

5. A vacuum-operated flush waste disposal toilet assembly for use on board commercial passenger aircraft, as well as trains, buses and ships, said assembly comprising:

a bowl for receiving waste matter;

a spray ring for supplying rinse water to said bowl, said spray ring having a disposable hollow tube selectively coupled to a first source of water and having a plurality of openings for dispensing the water onto the interior surface of said bowl, said disposable spray ring obviating the need for routine chemical cleaning; and a flush valve assembly coupled to a second vacuum source and to said bowl and being selectively openable to flush said bowl, said valve assembly including:

a valve blade movable between closed and open positions, said valve blade in the open position connecting said first source of vacuum to said bowl to suck waste out of said bowl;

a vacuum chamber having first and second vacuum inlet ports substantially at opposite ends of said chamber;

a piston vertically movable within said chamber, said piston attached to said valve blade so that movement of said piston in one direction opens said blade and the movement of said piston in the opposite direction closes said blade; and a flush solenoid which selectively connects said second source of vacuum to said first and second vacuum ports so that vacuum introduced at said first port causes movement of said piston in said one direction to move said blade to said open position and vacuum introduced at said second port causes movement of said piston in the opposite direction to move said blade to said closed position.

6. The assembly of claim 5, including a lightweight support base cradling said bowl, having a front end, a back end and side members including a pair of triangular composite legs for securely supporting said toilet assembly.

7. The assembly of claim 5, wherein said disposable spray ring is wedged between said bowl and a separate lip member for easy maintenance.

8. The assembly of claim 5, wherein a drain tube is connected between said flush valve assembly and a down line waste tank.

9. The assembly of claim 1, further comprising a hollow tube coupling said vacuum source to said first vacuum inlet when said flush solenoid connects said source of vacuum to said first vacuum inlet, a pocket of air entrapped in said hollow tube bleeding into said chamber through said first vacuum port when said flush solenoid connects said vacuum to said second vacuum port for causing the movement of said piston toward said second vacuum port.

10. A vacuum-operated flush waste disposal toilet assembly, comprising:

a bowl for receiving waste matter having a front, a rear and a top;

a rinse water supply coupled to said bowl;

waste tubing connecting said bowl to a vacuum source;

a flush valve assembly coupled to said waste tubing, selectively openable to flush said bowl, said flush valve assembly in the open position causing said vacuum source to suck the waste out of said bowl;

a lightweight support base used to cradle said bowl, comprising a front end and a back end, said ends connected by a pair of triangular composite legs, said front of said bowl about halfway down from said top of said bowl resting on said front end of said base, and said rear of said bowl being secured to said back end of said base.

11. The assembly of claim 10, wherein said triangular composite legs have openings for reducing the weight of said base.

12. The assembly of claim 10, wherein said rinse water supply includes a disposable spray ring tube selectively coupled to a source of water and having a plurality of openings for dispersing the water onto said bowl.

13. The assembly of claim 10, wherein said flush valve assembly includes a valve blade movable between closed and open positions, wherein said valve blade in the open position opens said valve assembly.

14. The assembly of claim 13, wherein said valve assembly further includes a vacuum chamber having first and second vacuum inlet ports at substantially opposite ends of said chamber, said chamber having a piston movable vertically within said chamber and connected to said valve blade such that the rise of said piston opens said blade and the descent of said piston closes said blade.

15. The assembly of claim 14, including a flush solenoid which selectively connects a second vacuum source to said first and second vacuum ports, vacuum introduced to said first port causing said piston to rise and vacuum introduced at said second port causing said piston to descend.

16. The assembly of claim 10, wherein the triangular composite legs of said support base provide working room between said base and a shroud encasing said base.

17. A vacuum-operated flush waste disposal toilet assembly, comprising:

a bowl for receiving waste matter;

a rinse water supply for said bowl;

waste tubing to connect said bowl to a first vacuum source; and a flush valve assembly connected to said tubing, selectively openable to flush said bowl, comprising:

a valve blade movable between closed and open positions, whereby said valve blade in the open position allows said first vacuum source to suck the waste out of said toilet bowl;

a vacuum chamber comprising a cylindrical housing having a top end and a bottom end, said housing further having a top vacuum inlet port located at said top end and a bottom vacuum inlet port located at said bottom end;

a piston movable vertically within said chamber, said piston attached to said blade such that the rise of said piston causes said blade to open and the descent of said piston causes said blade to close; and a flush solenoid selectively openable to connect a second vacuum source to said top and bottom inlet ports, whereby said solenoid in the open position applies said second vacuum source to said top port and said solenoid in the closed position applies said second vacuum source to said bottom port, whereby vacuum introduced to said top port causes said piston to rise and vacuum introduced to said bottom port causes said piston to descend.

18. The assembly of claim 17, wherein said rinse water supply comprises a disposable plastic tubing selectively coupled to a water source, containing a plurality of openings for the emission of water onto said bowl.

19. The assembly of claim 17, wherein said valve blade contains a port, whereby said valve blade in the open position aligns said port with the interior bores of said waste tubing.

20. The assembly of claim 17, wherein said piston contains a diaphragm which is selectively openable, so that when said flush solenoid valve connects said second vacuum source to said top port, said diaphragm is opened, and when said flush solenoid valve connects said second vacuum source to said bottom port, said diaphragm is closed, said diaphragm in the open position causing said piston to rise and said diaphragm in the closed position causing said piston to descend.

21. The assembly of claim 17, including means to selectively open and close said flush solenoid.

22. The assembly of claim 17, wherein said bowl is cradled and supported by a lightweight support base having a front end, a back end and side members including a pair of composite triangular legs, the front of said bowl about halfway down from the top of said bowl resting on said front end of said base and the rear portion of said bowl being secured onto the back end of said base.

23. A vacuum-operated flush waste disposal toilet assembly, comprising:

a bowl for receiving waste matter;

a disposable spray ring for supplying rinse water to said bowl located peripherally around the rim of said bowl and wedged between a top portion of said bowl and a separate lip member which overhangs said top portion of said bowl, said spray ring selectively coupled to a source of water and having a plurality of openings for dispensing the water onto said bowl directly from said ring, said disposable spray ring obviating the need for routine chemical cleaning by being replaceable when said spray ring is no longer functional;

a flush valve assembly coupled to said bowl, selectively openable to flush said bowl, whereby said flush valve assembly in the open position causes a first vacuum source to suck the waste out of said bowl through a waste tubing; and a lightweight support base cradling said bowl, having a front end, a back end and side members including a pair of triangular composite legs for securely supporting said toilet assembly.

24. The assembly of claim 23, wherein said spray ring is made out of malleable plastic conformed around the rim of said bowl, said spray ring being wedged between said bowl and said separate lip member for easy maintenance.

25. The assembly of claim 23, wherein said flush valve assembly includes a valve blade movable between closed and open positions, wherein said valve blade in the open position opens said valve assembly.

26. A vacuum-operated flush waste disposal toilet assembly, comprising:

a bowl for receiving waste matter;

a spring ring for supplying rinse water to said bowl located peripherally around the rim of said bowl and wedged between said bowl and a separate lip member, said spray ring having a disposable tube selectively coupled to a source of water and having a plurality of openings for dispensing the water onto said bowl, said disposable spray ring obviating the need for routine chemical cleaning;

a flush valve assembly coupled to said bowl, selectively openable to flush said bowl, whereby said flush valve assembly in the open position causes a first vacuum source to suck the waste out of said bowl through a waste tubing;

a lightweight support base cradling said bowl, having a front end, a back end and side members including a pair of triangular composite legs securely supporting said toilet assembly;

wherein said flush valve assembly includes a valve blade movable between closed and open positions, wherein said valve blade in the open position opens said valve assembly; and wherein said valve assembly further includes a vacuum chamber having a top end and a bottom end, said top end having a top vacuum inlet port and said bottom end having a bottom vacuum inlet port, said chamber further having a piston movable vertically within the interior of said chamber and connected to said valve blade, such that the rise of said piston opens said valve blade and the descent of said piston closes said blade.

27. The assembly of claim 26, including a flush solenoid which selectively connects a second vacuum source to said top and bottom inlet ports, wherein vacuum introduced at said top inlet port causes said piston to rise and vacuum introduced to said bottom inlet port causes said piston to descend.

28. A vacuum-operated flush waste disposal toilet assembly, comprising:

a bowl for receiving waste matter having a front, a rear and a top;

a spray ring for supplying rinse water to said bowl, located peripherally around the rim of said bowl and wedged between said top of said bowl and a separable lip member which overhangs said top of said bowl, said spray ring having a disposable tube selectively coupled to a source of water and having a plurality of openings for dispersing the water onto said bowl;

a flush valve assembly coupled to said bowl, selectively openable to flush said bowl, having a valve blade movable between open and closed position, whereby said valve blade in the open position opens said valve assembly and causes a first vacuum source located in a waste outlet tubing to suck the waste out of said bowl; and a lightweight support base used to cradle said bowl, comprising a front end and a back end, said ends connected by a pair of composite legs, said front of said bowl about halfway down from said top of said bowl resting on said front end of said base and said rear of said bowl being secured to said back end of said base.

29. The assembly of claim 28, wherein said valve assembly further includes a vacuum chamber having a top end and a bottom end, said top end having a top vacuum inlet port and said bottom end having a bottom vacuum inlet port, said chamber further having a piston movable vertically within the interior of said chamber and connected to said valve blade, such that the rise of said piston opens said valve blade and the descent of said piston closes said blade.

30. The assembly of claim 29, including a flush solenoid which selectively connects a second vacuum source to said top and bottom inlet ports, so that vacuum introduced at said top inlet port causes said piston to rise and vacuum introduced to said bottom inlet port causes said piston to descend.

31. The assembly of claim 28, wherein the triangulated structure of said composite legs provides for more working room between said base and a shroud encasing said base.

32. A vacuum-operated flush waste disposal toilet assembly, comprising:

a bowl for receiving waste matter having a front, a rear and a top;

a rinse water supply coupled to said bowl;

waste tubing for connecting said bowl to a first vacuum source;

a flush valve assembly coupled to said tubing, selectively openable to flush said bowl, comprising:

a valve blade movable between closed and open positions, said valve blade in the open position allowing said first vacuum source to suck the waste out of said bowl through said waste tubing;

a vacuum chamber comprising a cylindrical housing having a top end and a bottom end, said chamber further having a top vacuum inlet port located at said top end and a bottom vacuum inlet port located at said bottom end;

a piston movable vertically within said chamber, said piston attached to said blade so that rise of said piston causes said blade to open and descent of said piston causes said blade to close; and a flush solenoid selectively openable to connect a second vacuum source to said top and bottom inlet ports, said solenoid in the open position applying said second vacuum source to said top port and said solenoid in the closed position applying said second vacuum source to said bottom port, so that vacuum introduced to said top port causes said piston to rise and vacuum introduced to said bottom port causes said piston to descend; and a lightweight support base used to cradle said bowl, comprising a front end and a back end, said ends connected to each other by side members including triangular composite legs, said front of said bowl about halfway down from said top of said bowl resting on the front end of said base and said rear of said bowl being secured to said back end of said base.

33. The assembly of claim 32, wherein said rinse water supply includes a spray ring having a disposable tube selectively coupled to a source of water and having a plurality of openings for dispersing the water onto said bowl.

34. The assembly of claim 33, wherein said spray ring is wedged between said bowl and a lip member for easy maintenance.

35. The assembly of claim 32, including means to activate said flush solenoid from closed to open positions and vice versa.

36. The assembly of claim 32, wherein said composite legs are not vertical but slanted such that the bottom of said legs are set back from the front of said bowl so that additional working room is provided between said base and a shroud encasing said base.

37. A vacuum-operated flush waste disposal toilet assembly, comprising:

a bowl for receiving waste matter having a front, a rear and a top;

a spray ring for supplying rinse water to said bowl, said spray ring having a disposable tube selectively coupled to a source of water and having a plurality of openings for dispersing the water into said bowl;

waste tubing to connect said bowl to a first vacuum source;

a flush valve assembly coupled to said waste tubing, selectively openable to flush said bowl, comprising:

a valve blade movable between close and open positions, said valve blade int eh open position allowing said first vacuum source to suck the waste out of said toilet bowl through said waste tubing;

a vacuum chamber comprising a cylindrical housing having a top end and a bottom end, said chamber further having a top vacuum inlet port located at said top end and a bottom vacuum inlet port located at said bottom end;

a piston movable vertically within said chamber, said piston attached to said blade so that the rise of said piston causes said blade to open and the descent of said piston causes said blade to close; and a flush solenoid coupled to said vacuum chamber for selectively connecting a second vacuum source to said top and bottom inlet ports, said solenoid in the open position applying said second vacuum source to said top port and said solenoid in the closed position applying said second vacuum source to said bottom port, so that vacuum introduced to said top port causes said piston to rise and vacuum introduced to said bottom port causes said piston to descend; and a lightweight support base used to cradle said bowl, comprising a front end and a back end, said ends connected by a pair of triangular composite legs, said front of said bowl about halfway down from said top of said bowl resting on said front end of said base and said rear of said bowl being secured to said back end of said base.

38. The assembly of claim 37, including means to actuate said flush solenoid from close to open position and vice versa.

39. The assembly of claim 37, wherein said spray ring is wedged between said bowl and a separate lip for easy maintenance.

40. A vacuum-operated flush waste disposal toilet assembly comprising:

a bowl for receiving waste matter; and a flush valve assembly coupled to a vacuum source and to said bowl and being selectively openable to flush said bowl, said valve assembly including:

a valve blade movable between closed and open positions, said valve blade in the open position connecting said source of vacuum to said bowl to suck waste out of said bowl;

a vacuum chamber having first and second vacuum inlet ports substantially at opposite ends of said chamber;

a piston vertically movable within said chamber, said piston attached to said valve blade so that the movement of said piston in one direction opens said blade and the movement of said piston in the opposite direction closes said blade; and a flush solenoid which selectively connects a source of vacuum to said first and second vacuum ports so that vacuum introduced at said first inlet port causes said piston to rise and vacuum introduced at said second port causes said piston to descend, said first inlet port connected to a hollow tube containing ambient air so that when said flush solenoid connects a vacuum to said second inlet port, ambient air contained in said hollow tube bleeds into said first inlet port and into said chamber causing said piston to descend.

41. The assembly of claim 40, including a lightweight support base cradling said bowl, having front end, a back end and side members including a pair of obtuse, scalene triangular composite legs for securely supporting said toilet assembly.

42. The assembly of 40, wherein said piston having a diaphragm which is selectively openable, so that when said flush solenoid connects said source of vacuum to said first inlet port, said diaphragm is opened and when said flush solenoid connects said source of vacuum to said second inlet port, said diaphragm is closed, said diaphragm in the open position causing movement of said piston in one direction and said diaphragm in the closed position causing movement of said piston in the opposite direction.

43. The method of controlling the vacuum discharge of waste from a vacuum-operated flush waste disposal toilet assembly comprising the steps of:

continuously exposing an interior cavity of a piston located within a vacuum chamber to ambient air, said piston being attached to a movable valve member for selectively opening and closing a waste disposal path of said toilet assembly;

selectively opening said cavity to one side of said piston when a vacuum is drawn into the opposite side of said piston; and selectively closing said cavity to said one side of said piston when a vacuum is drawn into the same side of said piston.

44. The method of claim 43, comprising the step of selectively bleeding a surplus of ambient air into said opposite side of said piston when a vacuum is drawn into said one side of said piston.

45. The method of controlling a vacuum-operated discharge of waste from a vacuum-operated flush waste disposal toilet assembly, comprising the steps of:

continuously exposing an interior cavity of a piston located within a vacuum chamber to ambient air, said piston being attached to a movable valve member for selectively opening and closing a waste disposal path;

creating a vacuum on a top side of said piston, so that said piston displaces upwardly toward said vacuum;

opening said cavity to a bottom side of said piston so that an are below said piston within said chamber will be exposed to ambient air;

creating a vacuum on said bottom side of said piston so that said piston displaces downwardly;

closing said cavity to said bottom side of said piston; and bleeding a surplus of ambient air into an area in said chamber above said top side of said piston.

* * * * *